United States Patent [19]

Slater

[11] Patent Number: 4,591,148

[45] Date of Patent: May 27, 1986

[54] PORTABLE CLAMP AND ANCHOR

[76] Inventor: Olin Slater, P.O. Box 1431, Augusta, Ga. 30906

[21] Appl. No.: 628,230

[22] Filed: Jul. 6, 1984

[51] Int. Cl.[4] ..... A63B 23/02

[52] U.S. Cl. ..... 272/93; 272/900; 24/306; 128/DIG. 15; 273/DIG. 30

[58] Field of Search ..... 272/900, 93, 144, 145; 273/DIG. 30; 128/DIG. 15; 248/205.2, 231.4, 231.6; 24/306, 459

[56] References Cited

U.S. PATENT DOCUMENTS

| | | | |
|---|---|---|---|
| 1,760,346 | 5/1930 | Correa | 248/231.4 X |
| 2,050,652 | 8/1936 | Fleming | 272/144 |
| 2,425,971 | 8/1947 | Walker | 272/144 |
| 3,819,177 | 6/1974 | Spiro | 128/DIG. 15 |
| 4,116,434 | 9/1978 | Bernstein | 272/93 |
| 4,121,825 | 10/1978 | Hult . | |
| 4,141,524 | 2/1979 | Coruese, Jr. | 248/231.4 X |
| 4,176,835 | 12/1979 | Aziz . | |
| 4,182,510 | 1/1980 | Lundell | 272/93 |
| 4,185,816 | 1/1980 | Bernstein | 272/93 |
| 4,212,458 | 7/1980 | Bizilia | 272/93 |
| 4,230,103 | 10/1980 | Cote | 128/DIG. 15 X |
| 4,230,313 | 10/1980 | Chupp, Jr. . | |
| 4,323,235 | 4/1982 | Schwarz . | |
| 4,398,715 | 8/1983 | Hall | 273/DIG. 30 X |
| 4,457,510 | 7/1984 | Pertschuk | 272/93 |
| 4,468,022 | 8/1984 | Wu | 272/93 |
| 4,480,810 | 11/1984 | Hall | 248/231.4 X |

FOREIGN PATENT DOCUMENTS

| | | | |
|---|---|---|---|
| 3134902 | 3/1983 | Fed. Rep. of Germany | 272/93 |

*Primary Examiner*—Richard J. Apley
*Assistant Examiner*—David J. Brown
*Attorney, Agent, or Firm*—Bacon & Thomas

[57] ABSTRACT

A portable clamp and anchor to restrain feet during sit-up exercises having two clamp pieces which are adjustably positioned on the bottom of a door and a foot restraining piece which is adjustably positioned relative to the clamp pieces. Hook and loop fasteners are used to connect the pieces together during use.

4 Claims, 6 Drawing Figures

PORTABLE CLAMP AND ANCHOR

BACKGROUND OF THE INVENTION

1. Field of the Invention

The invention relates to a portable clamp and anchor which may be used to facilitate the performance of body conditioning exercises and, more specifically, may be used as a foot restraining device which aids in the performance of sit-ups.

2. Description of the Prior Art

The prior art is replete with foot restraining devices which aid in the performance of sit-ups. In particular, there have been many devices which can be secured to the bottom a door and the user's feet so that the user's feet may be restrained and anchored during exercising. Examples of these devices are seen in the U.S. Pat. Nos. 4,182,510 to Lundell and 4,185,816 to Bernstein.

There are a number of problems associated with the devices which are currently available. In attempting to design a portable clamp and anchor, considerations of weight, portability, compactness, ease in assembly and disassembly, low cost of manufacturing, simplicity in design and use such as adjustability in accommodating a particular size door and a particular size user are important.

The prior art is quite primitive in satisfying these criteria. Known devices are generally heavy in weight and lack portability and compactness because they are not collapsible. They are comparatively difficult to assemble and disassemble if such assembly steps are indeed present in the use of the device and if so, the mechanical fasteners used in the assembly operation add to the weight, the time involved in the assembly, and the lack of adjustability in accommodating a particular size door or a particular size user. Further, the prior art does not include a portable clamp and anchor which has a portion which can be attached to a relatively fixed structure and a portion which can be attached to the feet of a user which later can be attached to the former portion in a variety of relatively fixed positions to accommodate a variety of users with feet of different sizes and angular dispostions.

SUMMARY OF THE INVENTION

The present invention provides a holddown device for holding a body member in various selected positions relative to a relatively fixed structure and includes a body member engaging and restraining portion which engages and restrains the body member relative to the body member engaging and restraining portion, a structure engaging portion which engages a relatively fixed structure, and a connecting portion for connecting the body member engaging the restraining portion to the structure engaging portion so that the body member engaging and restraining portion can be releasably positioned in a variety of relatively fixed positions relative to the structure engaging portion and the relatively fixed structure.

The body engaging and restraining portion of the invention can be constructed from flexible fabric to engage a body member and also contain one portion of a hook and loop fastener which is engagable with the mating portion of the hook and loop fastener which is part of the structure engaging portion. The structure engaging portion can be the mating portion of the hook and loop fastener in and of itself or it can have further structure such as a two piece clamping structure which can be arranged to be attached to opposite sides of the bottom edge of a door in an adjustable fashion through the use of a hook and loop fastener in order to accommodate doors of different thicknesses. A further feature of the invention includes the use of a high friction, non-marring material which aids in preventing the removal of the structure engaging portion from the fixed structure by preventing the structure engaging portion from sliding along the surface of the fixed structure.

In contrast to the known prior art, the construction and design of the subject invention allows for a device which is low in weight and highly compact to increase the ease in portability. Further, it is easy to assemble and disassemble because of the arrangement of hook and loop fasteners of the type known by the trademark Velcro. The use of such fastening devices allows for further reductions in weight, low cost in manufacturing and a simplicity in design and use to allow for a wide range of adjustments to accommodate a variety of door sizes and users. The portion of the device which engages the user's foot may be fastened to the user's foot and then easily connected to and comfortably positioned against the portion of the device which was previously attached to a relatively fixed structure thereby allowing the user to have an arrangement which can be custom positioned regardless of the size or angular disposition of the user's foot.

DESCRIPTION OF THE PREFERRED EMBODIMENT

Figure 1:
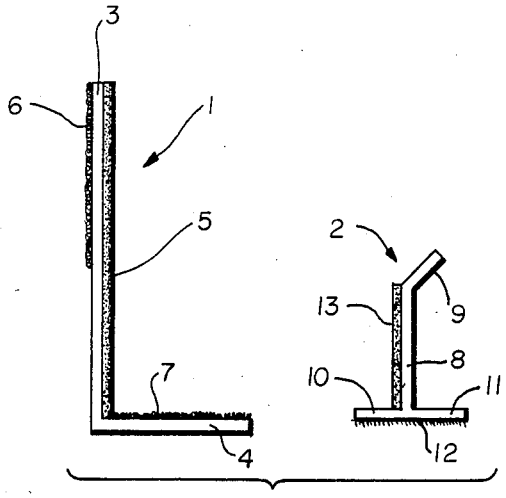
FIG. 1 is a side elevation view of the clamping portions of the device.
Figure 2:
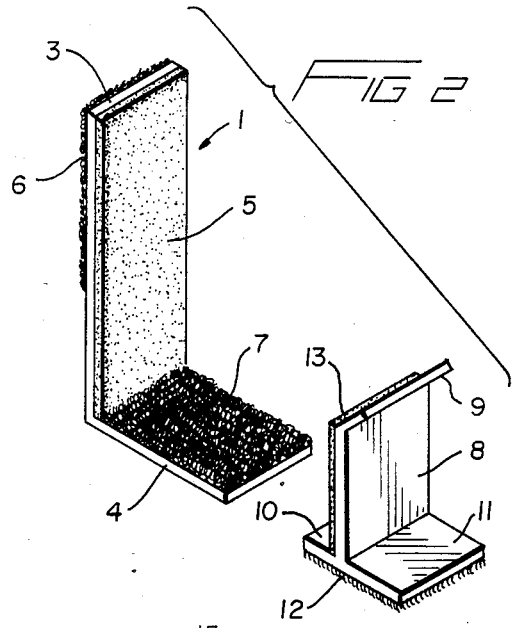
FIG. 2 is a perspective view of the clamping portions of the device.
Figure 3:
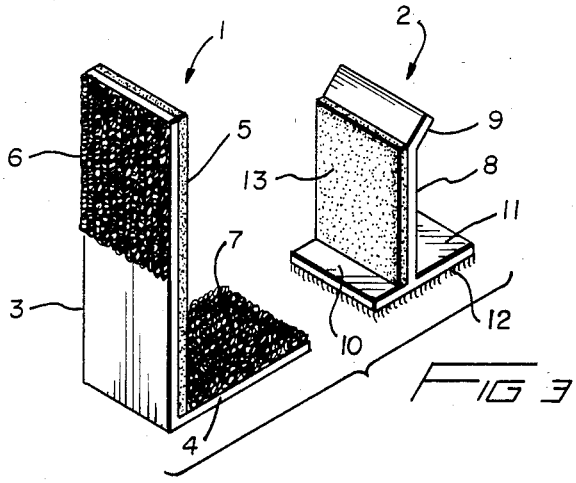
FIG. 3 is a second perspective view of the clamping portions of the device.

FIGS. 1–3 show the clamping portions of the preferred embodiment of the invention designated as front piece 1 and back piece 2. Front piece 1 is a L-shaped plate of stiff material, such as metal or plastic, having an upright portion 3 and a tongue portion 4. The inside surface of upright portion 3 is covered with a high friction, non-marring material 5 such as, for example, a foam polymer or a rubber material. A strip of hook and loop fastener material 6, commonly known by the trademark Velcro, is attached to the upper portion of upright portion 3 on the side opposite the high friction non-marring material 5. A strip of hook and loop fastener material is also attached to the upper side of tongue portion 4.

Back piece 2 resembles an inverted T-shape in cross-section and is made of a stiff sheet of material such as metal or plastic. It has an upright portion 8 with a grip portion 9 angling off from the top of upright portion 8. Back piece 2 also has an inwardly extending tongue portion 10 and an outwardly extending tongue portion 11. A strip of hook and loop fastener 12 is attached to the bottom of tongues 10 and 11. The inside surface of upright portion 8 is covered with a high friction non-marring material 13, preferably similar to material 5 described above.

Figure 4:
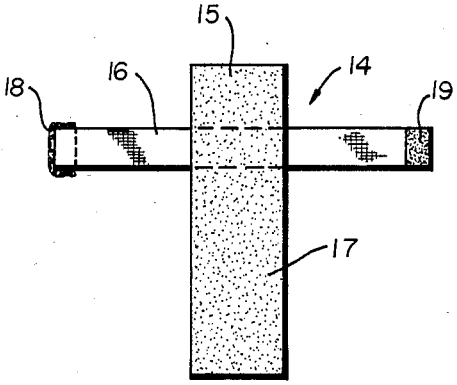
FIG. 4 is a bottom view of the foot restraining portion of the device.

A body member engaging and restraining element 14 is shown in FIG. 4. It includes a first strip portion 15 and a second strip portion 16 which is attached to first strip 15 by stitches, welds, or other fastening means in order to keep the two strip portions fastened together. Strip 15 and 16 are preferably made from a flexible but strong fabric such as nylon. A strip of hook and loop fastener material 17 is attached to one side of first strip 15. Second strip portion 16 has hook and loop fasteners 18 and 19 on its ends which can be brought together and fastened to form a loop for a foot as shown in FIG. 5.

Figure 5:
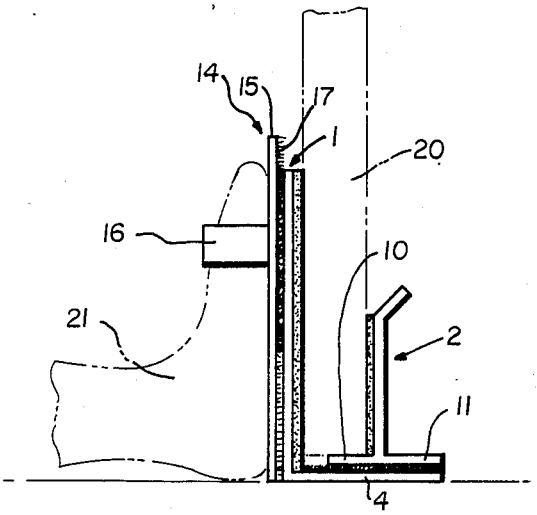
FIG. 5 is a side elevation view of the clamping portions of the device positioned on a door and the foot restraining portion of the device occupied by a foot and connected to the clamping portions of the device.
Figure 6:
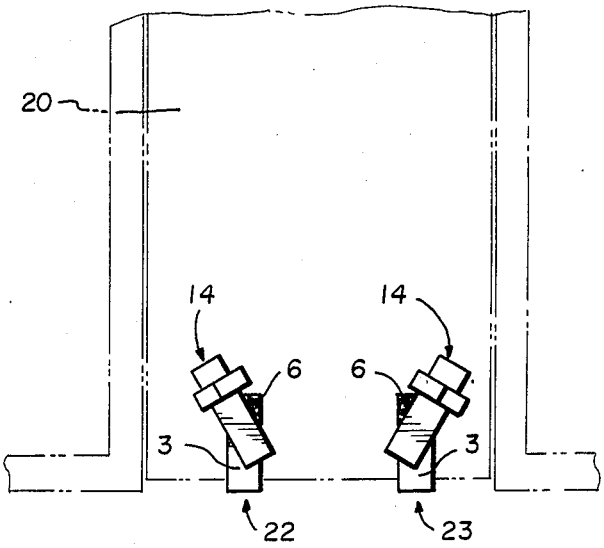
FIG. 6 is another side elevation view of the clamping portions of the device clamped onto the door and the foot restraining portions of the device connected to the clamping portions of the device in position for use.

FIGS. 5 and 6 show how the elements of the device are assembled and used. Tongue 4 of front piece 1 is slid underneath a relatively fixed surface such as, for example, a door 20, such that the surface bearing the high friction, non-marring material 5 is flat up against one face of the door.

Back piece 2 is put into position, for example, by sliding tongue portion 10 under the door from the opposite side, but in alignment with tongue portion 4 of front piece 1, until the surface bearing the high friction, non-marring material 13 is positioned against the opposite face of the door.

The surface of back piece 2 which bears hook and loop connector 12 is then pressed against the surface of front piece 1 which bears hook and loop connector 7 to form a firm connection which prevents front piece 1 from being pulled out from underneath the door.

Foot restraining means 14 is then attached to a body member, such as the foot of the user, by orienting first strip 15 to run longitudinally along the length of the user's foot and then fastening second strip 16 in a loop around the user's foot by connecting hook and loop connectors 18 and 19. Foot restraining means 14 is oriented on the user's foot such that hook and loop connector 17 faces away from the user's foot.

The user then connects hook and loop connector 17 to hook and loop connector 6 by placing his foot in a comfortable position against element 1. As shown in FIG. 6, this device allows comfortable accommodation for feet of various sizes and angular dispositions relative to front piece 1 and the door.

High friction, non-marring material 5 and 13 helps to prevent front piece 1 and back piece 2 from loosening and coming apart when the unit is in place and being used, by preventing front piece 1 and back piece 2 from sliding along the surfaces of the door. Grip portion 9 of back piece 2 aids in assembling and disassembling front piece 1 and back piece 2 by allowing the user to get a good grip on back piece 2 as back piece 2 is positioned against and removed from the flat surface of the door.

FIGS. 1–5 show one of the pair of devices which can be used to perform sit-up exercises. FIG. 5 shows an exerciser's foot 21 in position to do exercises. FIG. 6 shows a pair of the devices mounted on a door where device 22 is used to restrain the left foot and device 23 is used to restrain the right foot. Note that the restraining means 14 for each device can be independently positioned at a particular height or angle of orientation by means of the inventive arrangement of elements.

It is intended that the invention may involve using restraining means 14 in conjunction with a connecting portion which is attached to a stationary object other than the two elements securing means constituted by front piece 1 and back piece 2. For example, a strip of hook and loop fastener may be secured directly to a door, wall, frame, or other stationary object, and hook and loop fastener 17 may be connected to the first hook and loop fastener to anchor restraining means 14.

Although the inventive device has been described as being used as a foot restraining device for exercising, the broad concept of the invention is not so limited, since the example given in the specification is only a description of a preferred embodiment of one particular arrangement and use. It is to be understood that the scope for the invention is to be limited only by the following claims and not to the precise configuration and use described in this specification as a preferred embodiment.

What is claimed is:

1. A holddown device for a body member comprising a first element having a first surface, a first hook and loop fastener means comprising at least a portion of the first surface; a second element having a second surface, a second hook and loop fastener means matable with the first hook and loop fastener means comprising at least a portion of the second surface; said first element including at least one section positionable on one side of a fixed structure; said second element including at least one section positionable on the opposite side of said structure opposite said one side; said first hook and loop fastener means being adjustably fastenable to the second hook and loop fastener means so that the first element is connectable with the second element and adjustably positionable relative to the second element whereby the distance between the first element and the second element can be adjusted to accommodate fixed structures of various thicknesses; at least one of said first and second elements having means to engage and restrain the movement of a body member of an exerciser relative to said at least one of said elements.

2. A device as claimed in claim 1 further comprising connecting means wherein the means to engage and restrain is selectively separable from and attachable to said at least one of said first and second elements.

3. A device as claimed in claim 2 wherein the connecting means is a hook and loop fastener for enabling the means to engage and restrain to be adjustably positionable relative to the element to which it is attached.

4. A device as claimed in claim 3 wherein at least one of said first and second elements includes an upright means, said upright -means having upper and lower portions, and wherein the hook and loop fastener for engagement with the means to restrain is positioned only on the upper portion of said upper and lower portions.

* * * * *